United States Patent [19]

Belcher

[11] 4,228,417

[45] Oct. 14, 1980

[54] ELECTRIC FUSE AND METHOD OF MANUFACTURING THE SAME

[75] Inventor: Richard A. Belcher, Hampton Falls, N.H.

[73] Assignee: Gould Inc., Rolling Meadows, Ill.

[21] Appl. No.: 62,267

[22] Filed: Jul. 30, 1979

[51] Int. Cl.[3] ..... H01H 85/16

[52] U.S. Cl. ..... 337/252; 337/253

[58] Field of Search ..... 337/186, 190, 213, 214, 337/215, 231, 237, 246, 248, 251, 252, 253, 414

[56] References Cited

U.S. PATENT DOCUMENTS

| | | | |
|---|---|---|---|
| 1,810,653 | 6/1931 | Hartwig | 337/253 |
| 2,064,034 | 12/1936 | Rudnick | 337/253 X |
| 3,291,943 | 12/1966 | Kozacka | 337/276 X |

*Primary Examiner*—George Harris
*Attorney, Agent, or Firm*—Erwin Salzer

[57] ABSTRACT

A sub-assembly for electric fuses comprising a perforated fusible element having a pair of ribbon ends. The ribbon ends are bent around the rims of the casing from the inside to the outside of the casing. In fuses including such a sub-assembly one of the ends may be pre-bent, i.e. bent prior to insertion of the fusible element and its pair of ends into the casing. The other end or non-pre-bent end, must be bent around one of the rims of the tubular casing to the outer surface thereof preparatory to the mounting of the terminal caps, or ferrules, on the casing. This bending operation may involve great difficulties, particularly if the pair of ends have great dimensional stability, and the perforated fusible element portion is relatively frail, and tends to be twisted and/or otherwise deformed when one of the pairs of ends is bent around the rim of the casing to the outer surface thereof.

According to this invention the casing of the fuse is provided with a slot extending axially inwardly from one of its rims and has a sufficient length to allow insertion of the fusible element into said casing with both of its ends pre-bent. The pre-bent ends are angularly displaced relative to the slot in the casing which allowed the fusible element to be inserted into the casing with both ends thereof pre-bent.

Also described herein is a sub-assembly having a pair of longitudinal slots rather than but one.

9 Claims, 5 Drawing Figures

ELECTRIC FUSE AND METHOD OF MANUFACTURING THE SAME

BACKGROUND OF THE INVENTION

There are numerous prior art fuses to which the present invention may be applied, and the manufacture of which can greatly be simplified by the application of the invention. Such fuses are disclosed, for instance, in U.S. Pat. No. 3,319,028; May 9, 1967 to F. J. Kozacka for SPRINGLESS TIME LAG FUSE FOR MOTOR CIRCUITS; U.S. Pat. No. 3,341,674; Sept. 12, 1967 to P. C. Jacobs, Jr. for ELECTRIC QUARTZ-SAN-FILLED FUSE ADAPTED TO INTERRUPT EFFECTIVELY PROTRACTED SMALL OVERLOAD CURRENTS; U.S. Pat. No. 3,701,069; Oct. 24, 1972 to R. A. Belcher for ELECTRIC CARTRIDGE FUSE, and many more. However, I am not aware of any prior art structure that has any relation to the problem solved by the present invention.

SUMMARY OF THE INVENTION

Subassemblies for fuses according to the present invention include a tubular casing of electric insulating material having a pair of rims, and a perforated fusible ribbon element inside said casing. Said fusible ribbon element has a pair of ribbon ends extending from the inside of said casing to the outside thereof and bent around said pair of rims.

The noval features characterizing this invention consist in that said casing is provided with one slot extending axially inwardly from one of said pair of rims and being of sufficient size to allow insertion of said fusible ribbon element into said casing without the need of subsequent bending of said pair of ribbon ends. Said pair of ribbon ends and said slot being angularly displaced relative to each other to allow the terminal caps of the fuse when mounted on said casing to tightly press the ribbon ends of the fusible element against the outer surface of the casing.

DESCRIPTION OF PREFERRED EMBODIMENT

Figure 1:
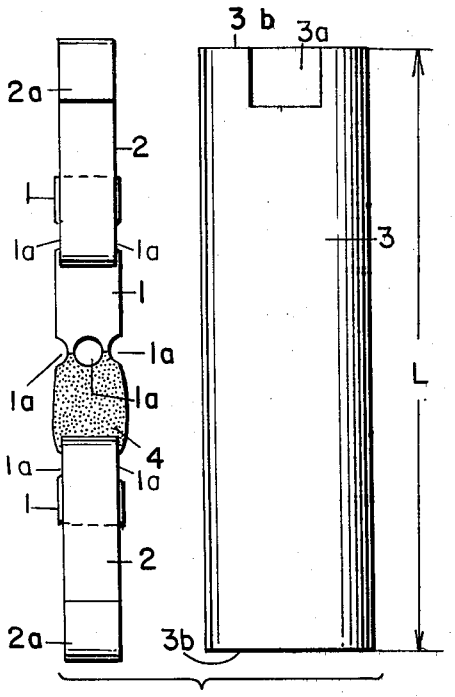
FIG. 1 shows an elevation of a fusible element as seen in the direction R of FIG. 5 and an elevation of a slotted casing into which said element is to be inserted with both ends thereof in a pre-bent state.
Figure 2:
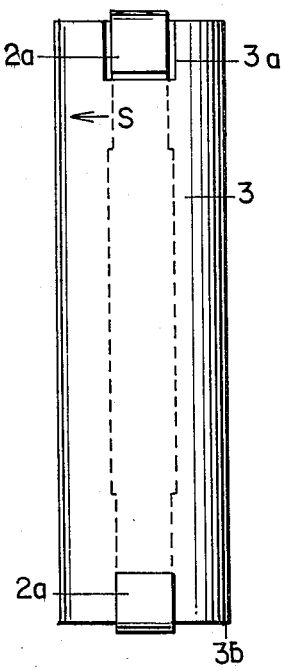
FIG. 2 shows in elevation the casing and the fusible element of FIG. 1 with both ends pre-bent inserted into the casing.
Figure 3:
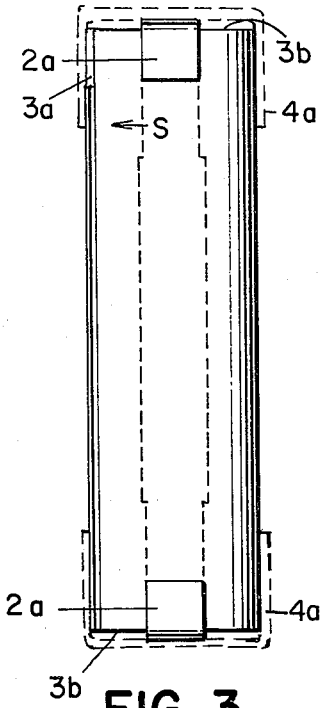
FIG. 3 shows in elevation the angular displacement of the fusible element and of the casing, and of its longitudinal slot, respectively.

Referring now to the drawings, and more particularly to FIGS. 1 and 3 thereof, numeral 1 has been applied to indicate a channel-shaped fusible element that is provided with serially arranged circular, or semicircular, perforations 1*a*. Three perforations 1*a* are arranged in series which yields an interrupting rating of 250 volts. Affixed to the web portion of element 1 are the ribbon ends 2. For reasons of economy the ribbon ends 2 of fusible element 1 may be of copper, while the fusible element 1 is of silver, since silver has the smallest $i^2 \cdot t$ value among the high fusing point metals. Since the fusible element 1 proper is channel-shaped, it is folded in a direction longitudinally thereof which tends to increase the time-lag for a predetermined current-rating. The ribbon ends 2 are relatively inexpensive to manufacture because they may be of copper, and their resistance may be equal, or even less, than if they were of silver because their thickness may be substantially larger than that of the fusible element 1 proper. The hair-pin shape of the ribbon ends 2 serves the purpose of accommodating a maximum length thereof in the length L of casing 3, and thereby minimizing the axial heat flow away from fusible element 1. In other words, ribbon ends 2 operate as effective heat dams. The axially outer ends of ribbons 2 are hook-shaped as indicated at 2*a*. Fusible element 1 is provided with an M-effect overlay 4 of tin, or of an alloy of tin, i.e. an overlay capable of severing fusible element 1 by a metallurgical interdiffusion process at a given temperature. Casing 3 may be made, e. g., of a laminate of convolutely wound glass-fibers and melamine resin, or another synthetic resin. As shown in FIG. 1 casing 1 has a slot 3*a* extending axially inwardly from one of the rims 3*b* of casing 3. Slot 3*a* extends axially inwardly from upper rim 3*b* and is of sufficient length to allow insertion of fusible element 1 into casing 3 with said pair of ribbon ends 2*a* in pre-bent state. In other words, the lower hooked end 2*a* of one of ribbon ends 2 is hooked to the lower rim 3*b* and the upper ribbon end 2*a* is juxtaposed to slot 3*a* so that the fusible element 1 plus the pre-bent ribbon ends 2,2*a*, are inserted into casing 3. This has been clearly shown in FIG. 2. Now the upper hooked ribbon end 2*a* and the upper slot 3*a* are substantially in registry. While fusible element 1 and the heat dam portion of its ends 2 must be situated inside of casing 3, a portion of the outer ends 2*a* of portions 2 must be outside of casing 3 to be conductively connected to the terminal caps of the fuse. It may, therefore, be necessary to impart a slight radial push to positions 2*a* to move them from the inside of casing 3 to the plane of its outer surface. Thereafter ribbon ends 2*a* and slot 3*a* are generally displaced relative to one another as shown in FIG. 3, so that ribbon ends 2*a* are moved away from slot 3*a* to a point of casing 3 where the upper ribbon end 2*a* is backed up by the outer surface of casing 3. Now the casing 3 may be provided with a lower cap 4*a*, filled with a pulverulent arc-quenching filler (not shown), and then closed by another or upper cap 4*a*.

Since this process of assembly does not call for any bending operation of the ribbon ends 2*a* after insertion of parts 1 and 2 into casing 3, the danger of distortion, or bending, of fusible element 1 by forces transmitted to it by a bending operation of upper ribbon end 2*a* is entirely avoided. This danger is particularly large in instances where fusible element 1 is, as usual, of relative thin sheet silver and ribbon ends 2*a* are of relatively thick sheet copper. But even if both fusible element 1 and parts 2 and 2*a* are of copper and parts 2 and 2*a* considerably thicker than fusible element 1, the danger of bending the latter through a bending operation of part 2*a* during the assembly of the fuse should be avoided.

As shown in all figures and rectangular cut-outs or slots 3*a* in casing 3 begin at rims 3*b* and are wider than ribbon ends 2*a*. Slots 3*a* extend axially inwardly of casing 3 a predetermined length. This length must be at least equal to the length h of the hook-shaped portion 2*a* of at least one of ribbon ends 2 to enable that hook-shaped portion 2*a* to be moved from the inside of casing 3 across the wall of casing 3 to the outer surface thereof.

If parts 1 and 2 are separate parts, the electric connection between the web portion of the fusible element 1 proper and the ends 2 thereof may be effected either on the inside of the web portions, or on the outside thereof.

FIG. 3 indicates in dotted line the terminal caps 4*a* which are finally affixed to the casing of the fuse. This process step does not form part of the process of manufacturing a sub-assembly according to the present invention, but is a necessary step in manufacturing a complete fuse. The axially inner circular ends of caps 4*a* may be affixed to casing 3 either by a crimping operation, or by a rolling operation as disclosed in U.S. Pat. No. 4,104,604 to Delbert L. George, Aug. 1, 1978 for NARROWLY KNURLED END CAP FOR AN ELECTRIC FUSE.

Figure 5:
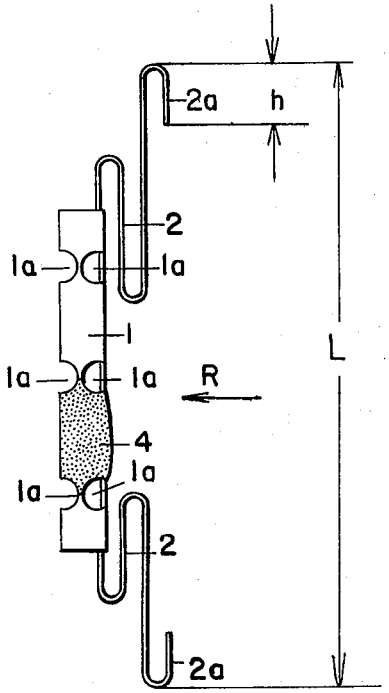
FIG. 5 shows in side elevation the fusible element of FIG. 1.

FIG. 3 shows also the last step in manufacturing fuses according to this invention, which includes the step of relative rotation of casing 3 with slot 3*a*, and ribbon end 2*a*, in clockwise direction, as indicated by arrows S in FIGS. 2 and 3. In these two figures the fusible element structure 1 and its strip ends 2 have been indicated diagrammatically by dotted lines since the structures 1 and 2 have been fully shown in FIGS. 1 and 5. The axis of rotation of parts 1 and 2 relative to which slot 3*a* of casing 3 has to be rotated is the longitudinal axis of casing 3.

Figure 4:
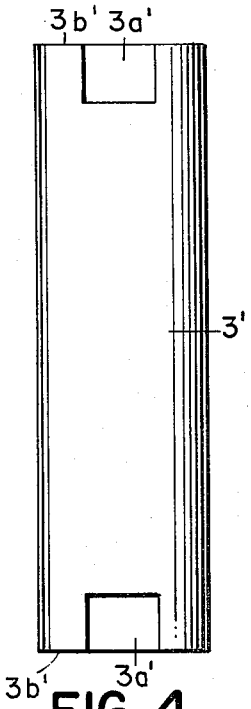
FIG. 4 shows a casing having two slots for the ends of the fusible element rather than but one slot as shown in FIGS. 1–3.

FIG. 4 illustrates a casing 3′ having a pair of aligned substantially rectangular incisions 3*a*′. The fusible element 1 proper and its ribbon ends 2 may be inserted into such a casing with the hook-shaped ends 2*a* thereof registering with the slots 3*a*′ in casing 3′. This eliminates the operation of hooking the lower of hook-shaped ends 2*a* to the lower rim 3*b*′ of casing 3′. After insertion of parts 1 and 2 into casing 3′ a relative rotary motion of hook-shaped ends 2*a* and casing 3′ about the longitudinal axis of casing 3′ will transfer ends 2*a* from slots 3*a*′ of casing 3′ to a point of the latter where both ends 2*a* are backed up by the outer wall of casing 3′.

It will be observed that neither the structure nor the process described in FIGS. 1–3 and 5, or in FIG. 4, respectively, requires a bending of parts 2,2*a* after insertion of the fusible element 1 and its ends 2,2*a* into the casing. In other words, ends 2,2*a* may be pre-bent and do not require any bending operation after insertion of fusible element 1 into its tubular casing 3,3′. Whether the first described method or the second described method is applied, both methods result in an equal angular displacement of hook-shaped ends 2*a* relative to slot 3*a*, or slots 3*a*′. It will also be observed that the spacing h between the hair-pin-shaped portions of ends 2*a* is equal to the length L of casing 3, and 3′, respectively.

What I claim as my invention is:

1. A sub-assembly of an electric fuse comprising a tubular casing of electric insulating material having a pair of rims, a perforated fusible ribbon element inside said casing, said fusible ribbon element having a pair of ribbon ends bent around said pair of rims from the inside of said casing to the outside thereof, wherein the novel features consist in that said casing has at least one slot extending axially inwardly from one of said pair of rims and being of sufficient length to allow insertion of said fusible ribbon element and its ribbon ends into said casing with said pair of ribbon ends in pre-bent state and said pair of ribbon ends and said slot being angularly displaced relative to each other.

2. A sub-assembly as specified in claim 1 wherein said casing is provided with a pair of registering slots each extending axially inwardly from one of said pair of rims and being of sufficient length to allow insertion of said fusible ribbon element into said casing with said pair of ribbon ends in pre-bent state, and said pair of ribbon ends and said slots being angularly displaced relative to each other to the same extent.

3. An electric fuse as specified in claim 1 wherein said perforated fusible ribbon element and said pair of ribbon ends thereof consist of different metals.

4. An electric fuse as specified in claim 1 wherein the thickness of said pair of ribbon ends of said perforated fusible ribbon element exceeds at least twice the thickness of said perforated fusible ribbon element.

5. A sub-assembly for an electric fuse comprising a tubular casing of electric insulating material having a pair of rims, a perforated fusible element inside said casing, said fusible ribbon element having a pair of ribbon ends bent around said pair of rims from the inside of said casing to the outside thereof, wherein the novel features consist in that said casing is provided with at least one substantially rectangular cut-out beginning at one of said pair of rims, the width of said cut-out exceeding the width of said pair of ribbon ends so that at least one of said ribbon ends may be moved from the inside of said casing through said cut-out to the other surface of said casing, and in that said cut-out and said pair of ends of said fusible ribbon element are angularly displaced in regard to the axis of said casing.

6. A sub-assembly as specified in claim 5 wherein said fusible element is of silver and said ends are of a metal having a smaller conductivity than silver, and are thicker than said fusible element, and are conductively connected to said fusible element.

7. A method of manufacturing a sub-assembly for an electric fuse comprising a tubular casing of electric insulating material having a pair of rims, a perforated fusible element inside said casing, said fusible element having a pair of ribbon ends bent around at least one of said pair of rims from the inside of said casing to the outside thereof, wherein the novel features consist in (a) cutting a longitudinal incision into said casing, said incision being open at one of the rims of said casing and closed at the opposite end thereof, said incision being of sufficient length to allow insertion of said fusible ribbon element with both its ribbon ends in a pre-bent state into said casing by registering at least one of said pre-bent ends with said incision; and (b) thereafter angularly displacing said incision of said casing relative to one of said pre-bent ends of said fusible element by a relative rotary motion of said casing and said one of said pre-bent ends of said fusible element about the longitudinal axis of said casing so that said one of said pre-bent ends is transferred from said incision to the outer surface of said casing.

8. A method of manufacturing a sub-assembly for an electric fuse including the steps of:

(a) providing a tubular casing of electric insulating material with a cut-out beginning at one of the rims of said casing and extending in a direction longitudinally thereof;

(b) inserting a fusible element into said casing which has a perforated center portion and a pair of bent ends adapted to engage the outer surface of said casing, said insertion of said fusible element into said casing being effected in such a way that one of said pair of bent ends registers with said cut-out in said casing; and of thereafter (c) rotating said casing and said fusible element relative to each other around the longitudinal axis of said casing so that said one of said pair of bent ends of said fusible element registering with said cut-out is transferred to the outer surface of said casing.

9. A method of manufacturing a sub-assembly for an electric fuse including the steps of:

(a) conductively connecting to a fusible element having points of serially related reduced cross-section a pair of pre-bent hook-shaped ribbon ends;

(b) providing a tubular fuse casing whose length is substantially equal to the largest spacing between said pre-bent hook-shaped ribbon ends with at least one axially extending incision that is sufficiently large to receive said one pre-bent hook-shaped ribbon end; and thereafter (c) angularly displacing said fusible element and said pair of pre-bent hook-shaped ribbon ends thereof relative to said casing so that said pre-bent hook-shaped ribbon ends are transferred to the outer surface of said casing where they are backed-up by said outer surface.

* * * * *